US007135095B2

(12) United States Patent
Oda et al.

(10) Patent No.: US 7,135,095 B2
(45) Date of Patent: Nov. 14, 2006

(54) PAPERMAKING PRESS FELT AND PRESS APPARATUS FOR A PAPERMAKING MACHINE

(75) Inventors: Hiroyuki Oda, Tokyo (JP); Shin Kawashima, Tokyo (JP); Kazumasa Watanabe, Tokyo (JP); Minenari Imada, Tokyo (JP); Hiroshi Iwata, Mihara (JP); Daisuke Goto, Mihara (JP); Hidemasa Iijima, Mihara (JP); Naoyuki Harada, Mihara (JP)

(73) Assignees: Ichikawa Co., Ltd., Tokyo (JP); Mitsubishi Heavy Industries, Ltd., Tokyo (JP)

( * ) Notice: Subject to any disclaimer, the term of this patent is extended or adjusted under 35 U.S.C. 154(b) by 82 days.

(21) Appl. No.: 10/693,271

(22) Filed: Oct. 24, 2003

(65) Prior Publication Data

US 2004/0137819 A1 Jul. 15, 2004

(30) Foreign Application Priority Data

Oct. 24, 2002 (JP) ..... 2002-310008

(51) Int. Cl.

| | |
|---|---|
| ***D21F 7/08*** | (2006.01) |
| ***D21F 3/02*** | (2006.01) |
| ***B30B 3/02*** | (2006.01) |
| ***B32B 5/06*** | (2006.01) |

(52) U.S. Cl. ..... 162/358.2; 162/358.1; 162/900; 442/271; 100/160

(58) Field of Classification Search ..... 162/109–117, 162/205–207, 358.1, 358.2, 360.2, 360.3, 162/900; 428/131, 137, 340; 442/1, 50–58, 442/268–275, 270, 271; 34/95, 116, 123; 100/37, 155 R, 153, 160

See application file for complete search history.

(56) References Cited

U.S. PATENT DOCUMENTS

| | | | | |
|---|---|---|---|---|
| 3,392,079 | A * | 7/1968 | Fekete | 428/113 |
| 4,259,394 | A * | 3/1981 | Khan | 442/270 |
| 4,500,588 | A * | 2/1985 | Lundstrom | 428/212 |
| 4,806,413 | A * | 2/1989 | Penven | 428/222 |
| 5,204,171 | A * | 4/1993 | Eschmann | 442/195 |
| 5,232,768 | A * | 8/1993 | Eklund et al. | 442/225 |
| 5,328,757 | A * | 7/1994 | Kenney et al. | 442/268 |
| 5,372,876 | A * | 12/1994 | Johnson et al. | 442/271 |
| 5,945,358 | A * | 8/1999 | Marchand | 442/240 |
| 6,159,880 | A * | 12/2000 | Schiel | 442/270 |
| 6,171,446 | B1 * | 1/2001 | Diaz-Kotti | 162/358.2 |
| 6,358,369 | B1 | 3/2002 | Yoshida et al. | |
| 6,592,636 | B1 * | 7/2003 | Joyce | 442/1 |
| 2004/0069432 | A1 * | 4/2004 | Hansen | 162/358.2 |
| 2004/0094281 | A1 * | 5/2004 | Hansen | 162/358.1 |

FOREIGN PATENT DOCUMENTS

| | | |
|---|---|---|
| GB | 2 200 867 A | 8/1988 |
| JP | 8888/1991 | 1/1991 |
| WO | WO 02/44468 A1 | 6/2002 |

* cited by examiner

*Primary Examiner*—Eric Hug
(74) *Attorney, Agent, or Firm*—Howson and Howson

(57) ABSTRACT

A press felt for use in a papermaking machine comprises a base body, a batt material and a hydrophilic nonwoven fabric, all intertwiningly integrated by needle punching. The batt material comprises a staple fiber, and is composed of a wet paper web side layer and a press side layer. The hydrophilic nonwoven fabric is provided in the wet paper web side layer. The hydrophilic character of the nonwoven fabric improves the movement of water to the nonwoven fabric, and the holding the water in the nonwoven fabric. As a result rewetting is prevented more effectively than in the case of prior press felts.

12 Claims, 10 Drawing Sheets

| | STRUCTURE OF NONWOVEN FABRIC | BASIS WEIGHT OF NONWOVEN FABRIC | WATER CONTACT ANGLE ON NONWOVEN FABRIC | BATT LAYER 31A | WATER CONTENT AT PRESS EXIT 2(%) | WATER CONTENT AT PRESS EXIT 1(%) | REWETTING EVALUATION |
|---|---|---|---|---|---|---|---|
| EXAMPLE 1 | NYLON 6 SPUNBOND | 40g/m$^2$ | 20° | MATERIAL:NYLON 6 STAPLE FIBER FINENESS:6 dtex BASIS WEIGHT: 200g/m$^2$ | 48.0 | 48.2 | ○ |
| EXAMPLE 2 | DITTO | 25g/m$^2$ | DITTO | DITTO | 48.0 | 48.7 | △ |
| EXAMPLE 3 | DITTO | 40g/m$^2$ | DITTO | MATERIAL:NYLON 6 STAPLE FIBER FINENESS: 6 dtex BASIS WEIGHT: 120g/m$^2$ | 48.1 | 48.8 | △ |
| EXAMPLE 4 | DITTO | 20g/m$^2$ | DITTO | MATERIAL:NYLON 6 STAPLE FIBER FINENESS: 6 dtex BASIS WEIGHT: 200g/m$^2$ | 47.5 | 50.1 | × |
| EXAMPLE 5 | DITTO | 100g/m$^2$ | DITTO | DITTO | 47.7 | 50.2 | × |
| EXAMPLE 6 | DITTO | 40g/m$^2$ | DITTO | MATERIAL:NYLON 6 STAPLE FIBER FINENESS: 11 dtex BASIS WEIGHT: 200g/m$^2$ | 48.1 | 48.6 | △ |
| EXAMPLE 7 | DITTO | DITTO | DITTO | MATERIAL:NYLON 6 STAPLE FIBER FINENESS: 17 dtex BASIS WEIGHT: 200g/m$^2$ | 48.2 | 48.8 | △ |
| COMPARATIVE EXAMPLE 1 | NONE | NONE | – | ALL BATT LAYERS MEET THE FOLLOWING CONDITIOONS: MATERIAL:NYLON 6 STAPLE FIBER FINENESS: 6 dtex BASIS WEIGHT: 100g/m$^2$ | 47.5 | 50.0 | × |
| COMPARATIVE EXAMPLE 2 | NONE | NONE | – | ALL BATT LAYERS MEET THE FOLLOWING CONDITIONS: MATERIAL:NYLON 6 STAPLE FIBER FINENESS: 17 dtex BASIS WEIGHT: 100g/m$^2$ | 47.8 | 50.2 | × |
| COMPARATIVE EXAMPLE 3 | POLYESTER SPUNBOND | 40g/m$^2$ | 40° | MATERIAL:NYLON 6 STAPLE FIBER FINENESS: 6 dtex BASIS WEIGHT: 200g/m$^2$ | 48.0 | 50.0 | × |
| COMPARATIVE EXAMPLE 4 | NYLON 6 SPUNBOND (PROVIDED ON SURFACE OF BASE BODY 20 ON ROLL SIDE) | 40g/m$^2$ | 20° | MATERIAL:NYLON 6 STAPLE FIBER FINENESS: 6 dtex BASIS WEIGHT: 200g/m$^2$ | 47.6 | 50.0 | × |

REWETTING EVALUATION:1-2→BELOW 0.5:○, 0.5 OR MORE AND BELOW 1.0:△, ABOVE 1.0:×

FIG. 11

PAPERMAKING PRESS FELT AND PRESS APPARATUS FOR A PAPERMAKING MACHINE

FIELD OF THE INVENTION

This invention relates to a felt for use in the press part of a papermaking machine, and more particularly to a press felt having improved water removing capability, and to the press part of a papermaking machine utilizing the press felt.

BACKGROUND OF THE INVENTION

A conventional press apparatus used for squeezing water from a wet paper web in a papermaking process has four press nips, and is shown in FIG. 1.

A wet paper web W, having a density of 15–18%, formed in a wire part of the papermaking apparatus, is sucked onto a suction pickup roll 2 and attached to a pickup felt 3. Water is squeezed from the wet paper web through the felt 3, and a bottom felt 4, in a first press 1P which is referred to as a "double felt press," since it comprising two felts 3 and 4, as well as a suction roll 5 and a grooved roll 6*a*.

The wet paper web is held on the surface of the pickup felt 3, and sucked by vacuum of the suction roll 5. Water is further squeezed from the wet paper web in a single felt press 2P, which comprises a center roll 6, having a dense, smooth surface, and a grooved roll 6*b*.

Rewetting of the wet paper web W, that is, the return of water from the press felt to the wet paper web, occurs in this process where the wet paper web is transferred from the first nip formed by rolls 5 and 6*a*, to the second nip formed by rolls 6 and 6*b*.

After the pickup felt 3 transfers the wet paper web W to the center roll 6, water is squeezed from the wet paper web in a third press 3P, comprising the roll 6 and a third grooved roll 6*c*, and in a fourth press 4P, comprising a roll 7 and a grooved roll 6*d*. Thereafter, the wet paper web is transferred to a dryer part of the papermaking apparatus, comprising dryer rolls 8.

A double felt press nip is shown in detail in FIG. 2. The press nip comprises a pair of press rolls P, and a pair of press felts 11, which pinch a wet paper web W. The press felts 11, and the wet paper web W, are compressed by the press rolls P, and thus water is squeezed from the wet paper web W.

While FIG. 2 shows a roll press wherein a nip comprises two rolls, alternatively, a shoe press may be used, in which the nip comprises a roll and a shoe press module. In the shoe press, as in the roll press, press felts absorb water squeezed from a wet paper web.

The structure of a press felt 11, of the kind generally used in papermaking, is shown in FIG. 3, which is a cross-sectional view taken on a plane extending in the machine direction. The felt 11, shown in of FIG. 3, is an endless press felt, comprising a base body 20 and layers 30 of batt material. The batt material comprises a wet paper web side layer 31 and a press side layer 32. The batt material is formed by needle punching a batt fiber to the base body 20. Thus, batt fiber is provided inside the base body 20.

The movement of water from the wet paper web in the press part of FIG. 2 is illustrated in FIG. 4. For simplicity, only one press felt 11 is shown in FIG. 4. When the two press rolls P rotate in the directions shown by the arrows in FIG. 4, the press felt 11 and a wet paper web W are pinched by the press rolls P as they pass through the press part. As mentioned above, the press felt 11, and the wet paper web W, are compressed in the press part, and water is squeezed out of the wet paper web W and absorbed in the press felt 11.

However, when the wet paper web and the press felt are transferred from the center of the nip to the delivery side of the press part, the pressure applied to the wet paper web W and the press felt 11 is rapidly released, and the press felt 11, and the wet paper web W, rapidly expand in volume. As a result, a negative pressure is created in the press felt 11. Moreover a capillary phenomenon occurs, since the wet paper web comprises thin fibers. The negative pressure and the capillary phenomenon cause water absorbed in the press felt 11 to return to the wet paper web W. This "rewetting" phenomenon and is generally known by those skilled in the art as a problem in a conventional press apparatus.

While FIG. 4 shows a case of a roll press nip, the same phenomenon occurs in the case of a shoe press nip. In both types of press nip, rewetting is a major cause of decreased water removal capability.

One conventional press felt designed to reduce rewetting, is shown in FIG. 5, and described at page 3 of Unexamined Japanese Patent Publication 8888/1991. In this press felt, a barrier layer 41, comprising super-fine fibers or a hydrophilic material, is formed in a press side part 32 of the batt material.

In another conventional press felt, shown in FIG. 6 and described in U.S. Pat. No. 5,372,876 a hydrophobic spun bond layer 42 is provided as part of the wet paper web side part 31 of the batt material.

The results of experiments have revealed that the structures shown in FIGS. 5 and 6 did not sufficiently prevent rewetting. The inability of press felt 12 of FIG. 5 to prevent rewetting appears to be due to the fact that, while water is held in the barrier layer 41 comprising super-fine fibers or hydrophilic material, water in the wet paper web side layer 31, which lacks the barrier layer material, returns to the wet paper web after the press felt is released from the press part of the machine.

In the case of the press felt 13 of FIG. 6, the hydrophobic spun bond material 42 prevents water which is located on the roll side relative to the spun bond material from moving to the wet paper web. However, the press felt of FIG. 6 does not function effectively to prevent rewetting, apparently because, since the spun bond material 42 is hydrophobic, water held inside the spun bond material, and water located in the batt layer on the wet paper web side of the spun bond material, move easily to the wet paper web.

In view of the above problems, it is an object of the invention to provide a papermaking press felt and a press apparatus which more effectively prevent rewetting.

SUMMARY OF THE INVENTION

The papermaking press felt in accordance with the invention has certain conventional features in that it comprising a base body and a batt material, the batt material being composed of a wet paper web side layer and a press side layer. However, the press felt differs from conventional press felts in that it comprises a hydrophilic, nonwoven fabric provided in the wet paper web side layer of the batt material.

Where the batt material comprises staple fibers, the fineness of the staple fibers located on the wet paper web side of the hydrophilic nonwoven fabric is preferably 9 dtex or less.

Preferably, the ratio of the basis weight of the part of the batt material located on the wet paper web side of the hydrophilic nonwoven fabric to the basis weight of the hydrophilic nonwoven fabric is in the range from 8:1 to 3:1.

The water contact angle of the hydrophilic nonwoven fabric is preferably 30 degrees or less when the water content of the nonwoven fabric is 30–50%.

A press apparatus of a papermaking machine according to the invention incorporates the felt previously described. The felt may be one of two felts in a double felt press, or may be a single felt on which a wet paper web is transferred out of a press apparatus. The felt may be incorporated in one or plural successive press apparatuses of a papermaking machine, and is most effective when incorporated into the last one of a series of press apparatuses.

The press felt in accordance with the invention has a relatively simple structure, and, when incorporated into a press apparatus of a papermaking machine, it exhibits excellent water removal and excellent prevention of rewetting.

BRIEF DESCRIPTION OF DRAWINGS

FIG. 11 is a chart showing the results of tests carried out using the testing apparatuses of FIGS. 9 and 10;

DETAILED DESCRIPTION OF THE PREFERRED EMBODIMENTS

Embodiments of a press felt according to the invention will be explained with reference to FIGS. 7 and 8, which are cross-sectional views taken on section planes extending in the machine direction.

Figure 1:
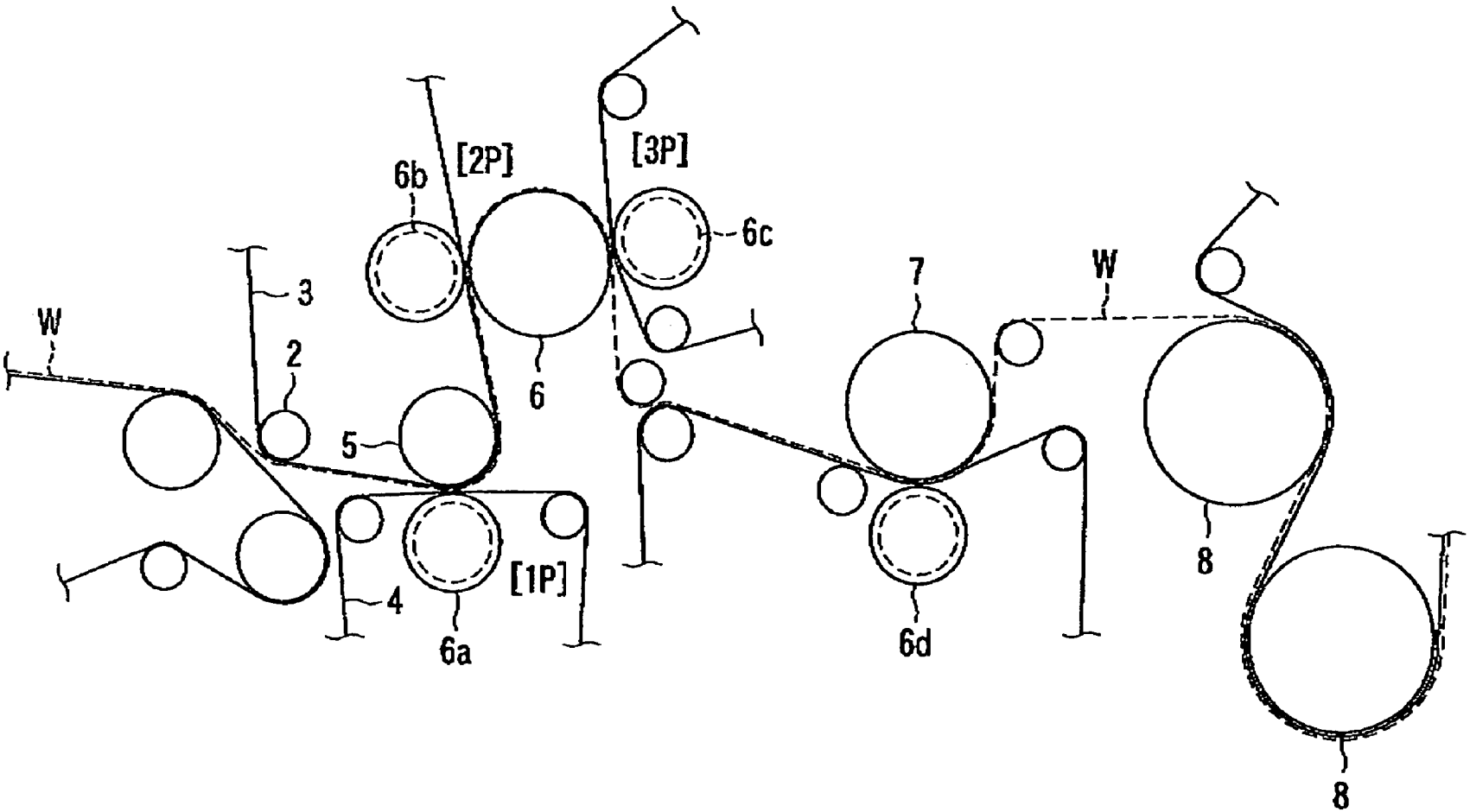
FIG. 1 is a schematic explanatory view of a press apparatus of a papermaking machine.
Figure 2:
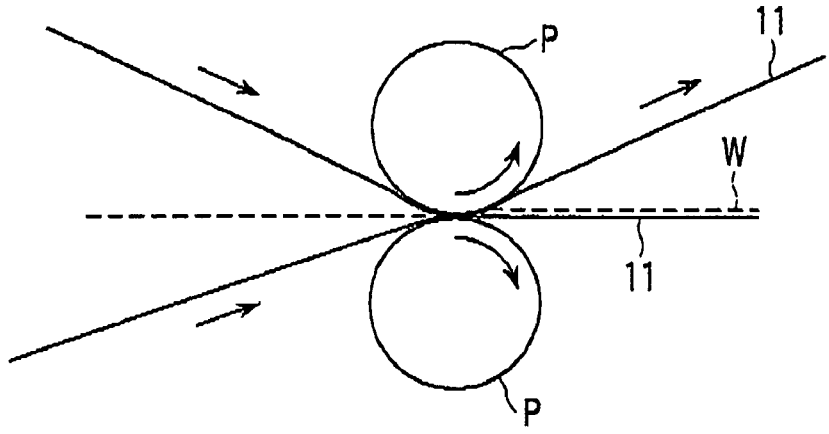
FIG. 2 is a schematic explanatory view of a press nip.
Figure 3:
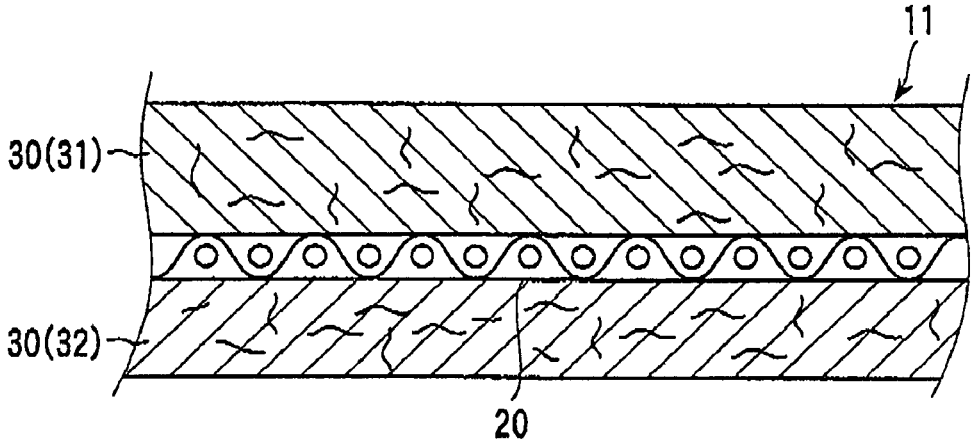
FIG. 3 is a cross-sectional view of a conventional press felt.
Figure 4:
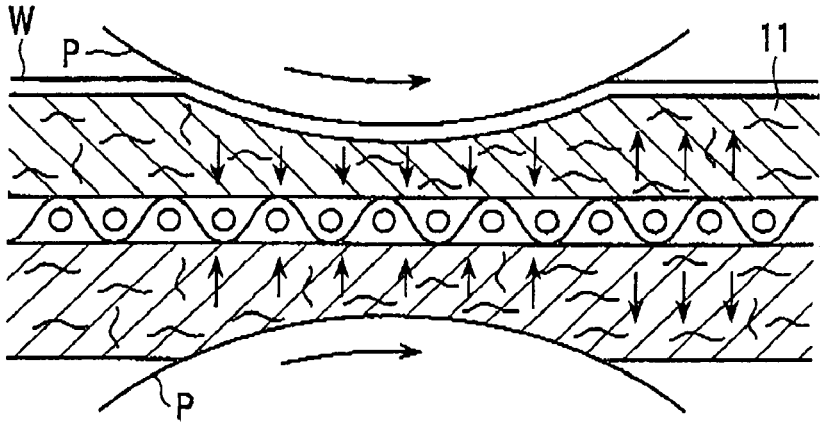
FIG. 4 is an explanatory cross-sectional view showing the movement of water to and from a wet paper web in the press part of a papermaking machine.
Figure 5:
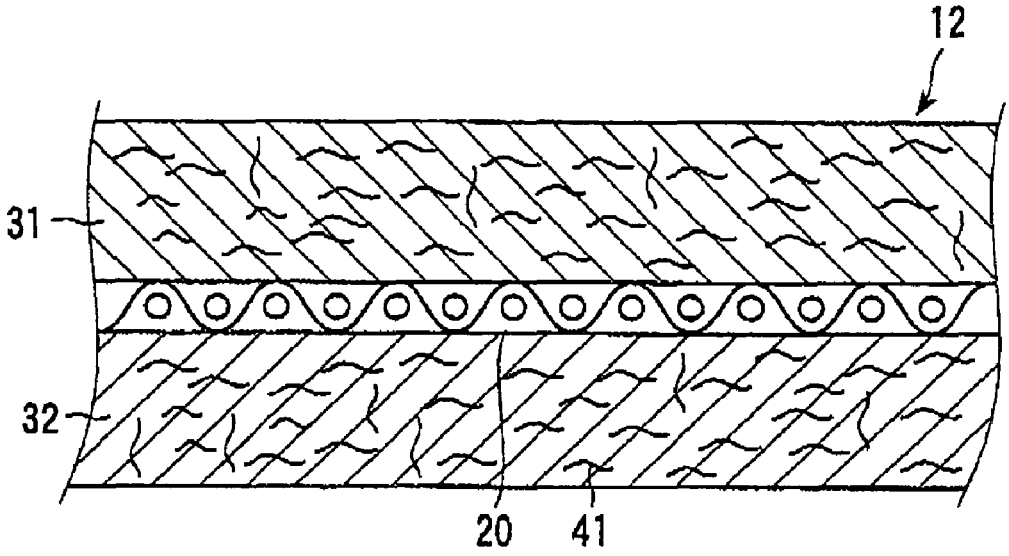
FIG. 5 is a cross-sectional view of another conventional press felt.
Figure 6:
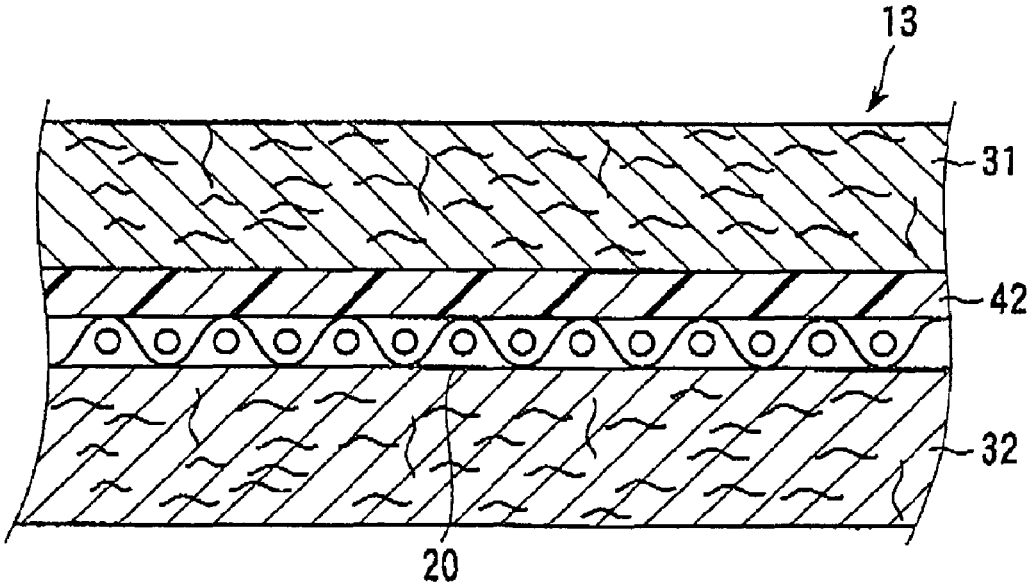
FIG. 6 is a cross-sectional view of still another conventional press felt.
Figure 7:
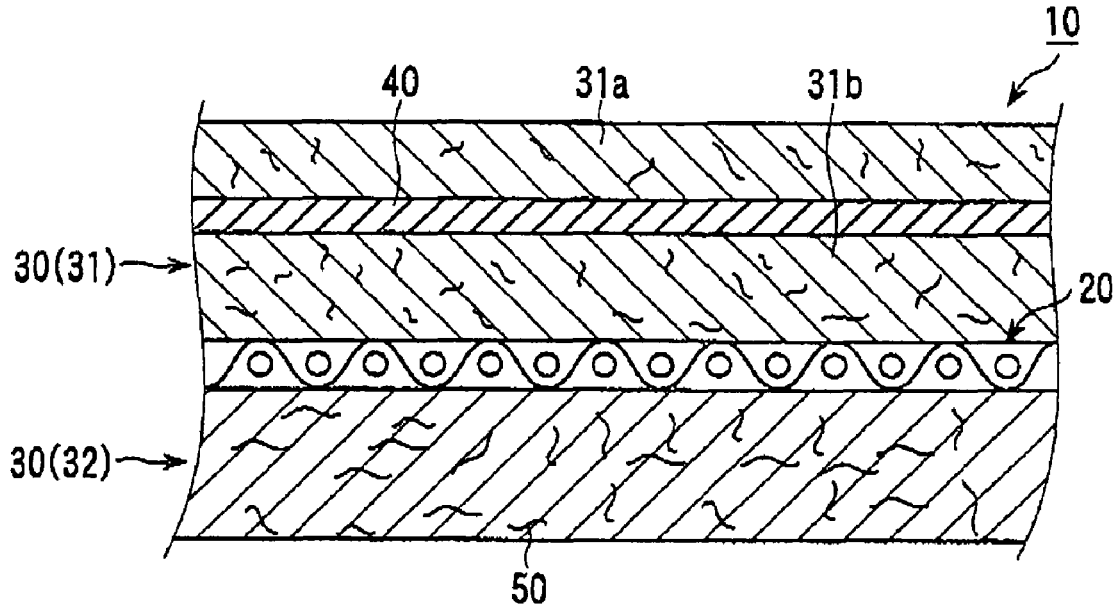
FIG. 7 is a cross-sectional view of an embodiment of a press felt according to the invention.
Figure 8:
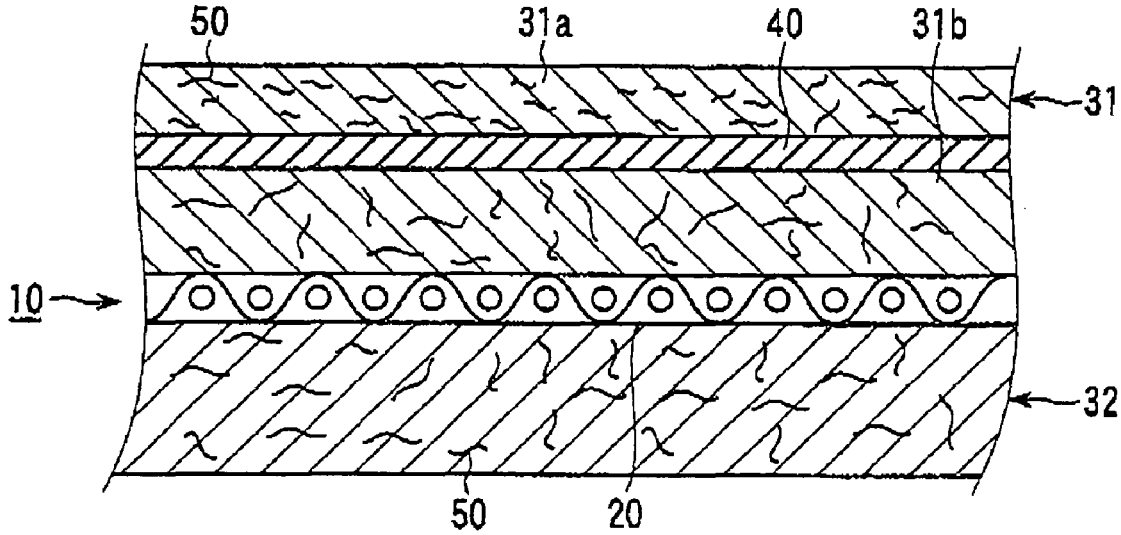
FIG. 8 is a cross-sectional view of another embodiment of a press felt according to the invention.

In both of FIGS. 7 and 8, a press felt 10 comprises a base body 20, a batt material 30, and a hydrophilic nonwoven fabric 40, all of which are intertwiningly integrated by needle punching.

The base body 20 imparts strength to the press felt. A woven fabric, a structure wherein yarns are not woven but stacked, or a film or the like, are known to those skilled in the art as suitable for base bodies, and may be used as base bodies in the press felt according to the invention.

The batt material 30 comprises a staple fiber 50, and is composed of a wet paper web side layer 31 and a press side layer 32. The staple fiber 50 is also provided in the base body 20.

A fiber with fineness of 6 dtex or more is used as the staple fiber 50 forming the batt material 30. A fiber having fineness of about 17 dtex is preferred.

A natural fiber such as wool, and a synthetic fiber such as nylon 6 or nylon 66, which are superior in wear resistance, fatigue resistance, extension characteristics, and stain resistance, are preferably used as materials for the base body 20 and the batt material 30.

The hydrophilic nonwoven fabric 40 is provided in the wet paper web side layer 31 of the batt material 30. Therefore, the wet paper web side layer 31 is composed of a first sublayer 31*a*, located on the wet paper web side relative to the hydrophilic nonwoven fabric 40, and a second sublayer 31*b*, located on the roll side relative to the hydrophilic nonwoven fabric 40.

The hydrophilic nonwoven fabric 40 comprises fibers which are thinner, and of higher density, compared to the fibers of the batt material 30. The hydrophilic nonwoven fabric is formed by laminating fibers which are made by melting and spinning resin. For example, a spun bonded nonwoven fabric, formed by laminating a continuous filament may be used. As another example, a nonwoven fabric, formed by extending molten polymer with a hot blast, thereby making fine fibers, and forming a sheet therefrom, may be used. A suitable fineness of the fibers of the nonwoven fabric 40 is 4 dtex or less. Nylon may be used as the material of the fine fibers of the non-woven fabric.

Excellent results are obtained when the hydrophilic level of the nonwoven fabric 40 is such that the water contact angle is 30 degrees or less when the water content of the nonwoven fabric is adjusted to 30–50%. The percentage water content of the nonwoven fabric is 100 times the weight of the water content, divided by the overall weight of the fabric, including its water content.

When a nylon spun bond material is purchased for use as a nonwoven fabric, it may be hydrophobic at the time of purchase. This is due to the fact that hydrophobic spinning oil is normally used in the manufacture of a spun bond material for improving its opening properties and fiber cohesion. However, the hydrophobic oil escapes from the spun bond material at a very early stage in the use of the papermaking felt incorporating the spun bond material. Thus, even though a nonwoven fabric may be hydrophobic at the time of its purchase, the object of the invention may be achieved, if the nonwoven fabric becomes hydrophilic when in use. It is sufficient that the nonwoven fabric have hydrophilic properties when the papermaking press felt is in normal use.

The function of the press felt 10 shown in FIG. 7 is as follows.

First, water from a wet paper web moves to the press felt 10 as a result of pressure applied by the press rolls. Then, as explained above, when the press felt travels beyond the press rolls and the pressure is released, the rewetting phenomenon occurs. However, in the case of a press felt 10 according to the invention, the hydrophilic nonwoven fabric 40 has a higher density and lower water permeability than the batt fiber. Therefore, water in the part of the batt material located on the roll side relative to the hydrophilic nonwoven fabric 40, that is water in the sublayer 31*b*, does not readily pass through the hydrophilic nonwoven fabric 40 and return to the wet paper web.

Furthermore, since fibers of the hydrophilic nonwoven fabric 40 are finer than those of the batt material 30, water held in sublayer 31*a* on the wet web side of the hydrophilic nonwoven fabric 40 readily moves into the fabric 40 due to the capillary phenomenon.

Furthermore, the hydrophilic nonwoven fabric exerts a "hydration force." That is, the hydrophilic character of the nonwoven fabric 40 remarkably improves not only the movement of water into the nonwoven fabric 40, but also the holding of the water in the batt fiber layer. Thus, water in the sublayer 31*a*, which is the nearest the wet paper web, is either held in the sublayer 31*a* by the hydration force, or is prevented from moving to the wet paper web by the hydrophilic character of the nonwoven fabric 40 itself.

As a result, the press felt according to the invention prevents rewetting more effectively than a conventional press felt.

Water held in the sublayer 31*a*, which is located on the wet paper web side relative to the hydrophilic nonwoven fabric 40, is less likely to cause rewetting than in the case of a conventional press felt because of the hydration force exerted by the hydrophilic nonwoven fabric 40. However, even in the case of a hydrophilic nonwoven fabric layer, a part of water in sublayer 31*a* moves to the wet paper web.

The hydration force in the sublayer 31*a* may be increased by using fibers which are thinner than conventional fibers as staple fibers 50, as shown in FIG. 8, so that the amount of water moving from the sublayer 31*a* to the wet paper web is further reduced. Since the staple fibers 50 of the sublayer 31*a*, which is in direct contact with the wet paper web, are thinner than conventional fibers, the difference between the fineness of the staple fibers 50 of layer 31*a*, and the fiber of the wet paper web, becomes relatively small. Therefore, the amount of water moving from the sublayer 31*a* to the wet paper web due to the capillary phenomenon becomes relatively small.

It was determined, from the results of tests, that excellent effects can be obtained when the fineness of a staple fiber 50 of the outermost wet paper web side sublayer 31*a* is 9 dtex or less.

It was also determined that the weight ratio of the outermost wet paper web side sublayer 31*a* to a hydrophilic nonwoven fabric layer had a close relationship to the prevention of rewetting. The basis weight ratio (that is, the ratio of the weights per unit area) of the outermost wet paper web side layer 31*a* to the hydrophilic nonwoven fabric layer 40 was preferably in the range from 8:1 to 3:1.

A suitable basis weight of the outermost wet paper web side layer 31*a* is 100–200 g/m$^2$, while the basis weight of the hydrophilic non-woven fabric 40 is in the range of about 16–50 g/m$^2$.

EXAMPLES

Tests were conducted to determine the effects of papermaking press felts according to the invention.

A basic structure of all the felts was as follows, so that certain conditions were common to both the examples of the invention and the comparative examples. In particular, the base body, which was a plain weave composed of nylon of nylon monofilament twine, had a basis weight of 300 g/m$^2$. The batt material, which was composed of staple fibers of nylon 6 had a total basis weight of 550 g/m$^2$. The needle punching density was 700 times/cm$^2$.

Except in comparative examples 1 and 2, a hydrophilic nonwoven fabric was provided in a wet paper web side sublayer of the batt material, the batt material had a first wet paper web side sublayer and a second wet paper web side sublayer. In the examples in accordance with the invention, and in the comparative examples other than comparative examples 1 and 2, the fineness of the fibers of the inner wet paper web side sublayer and the press side layer was 17 dtex.

As shown in FIG. 11, the examples and the comparative examples were obtained by changing the material, fineness, and basis weight of the batt material, and in the case of examples 1–7 and comparative examples 3 and 4, by changing the structure and basis weight of the nonwoven fabric layer, and the water contact angle on the nonwoven fabric layer.

Figure 9:
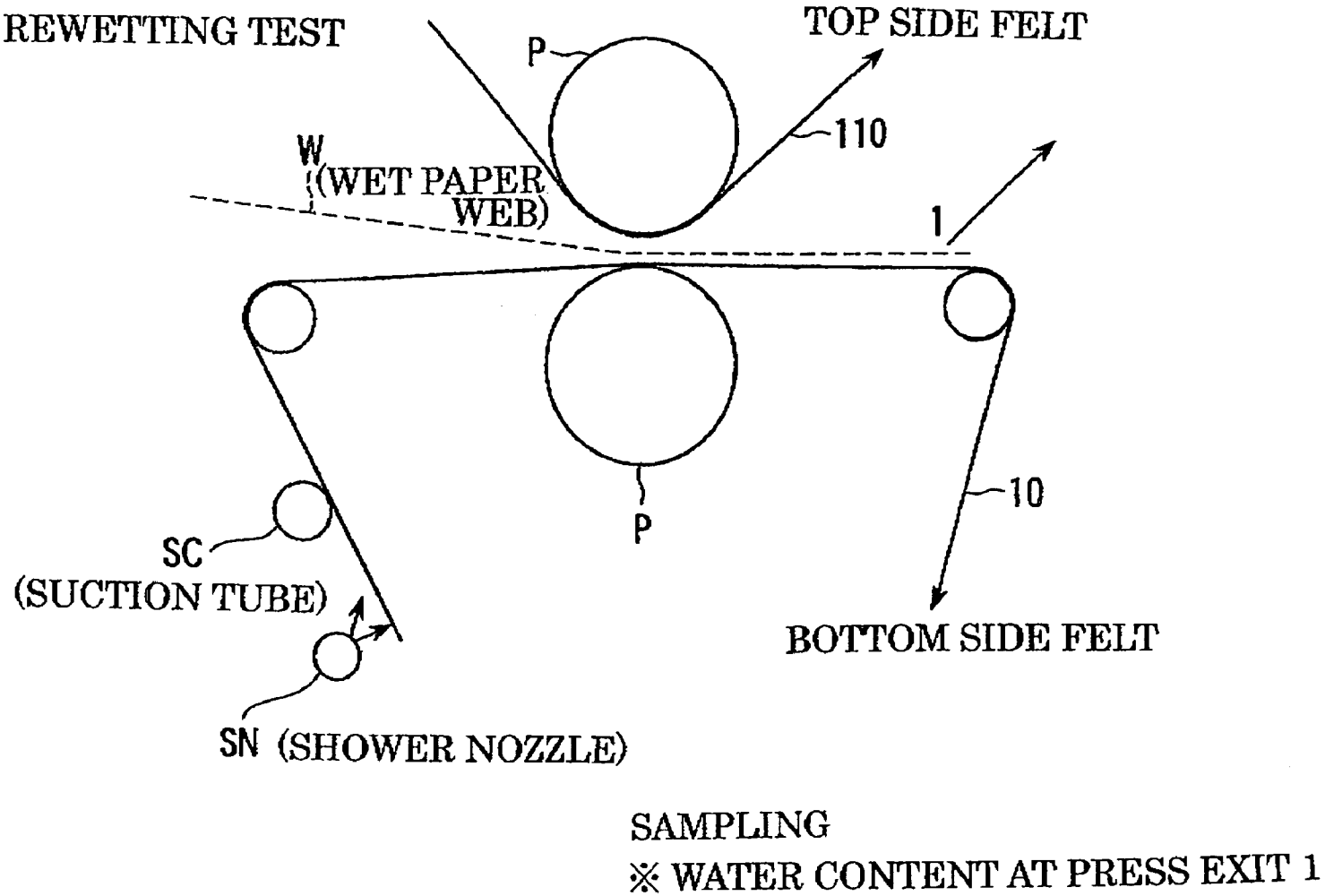
FIG. 9 is a schematic view of an apparatus for determining the effects of a press felt according to the invention.
Figure 10:
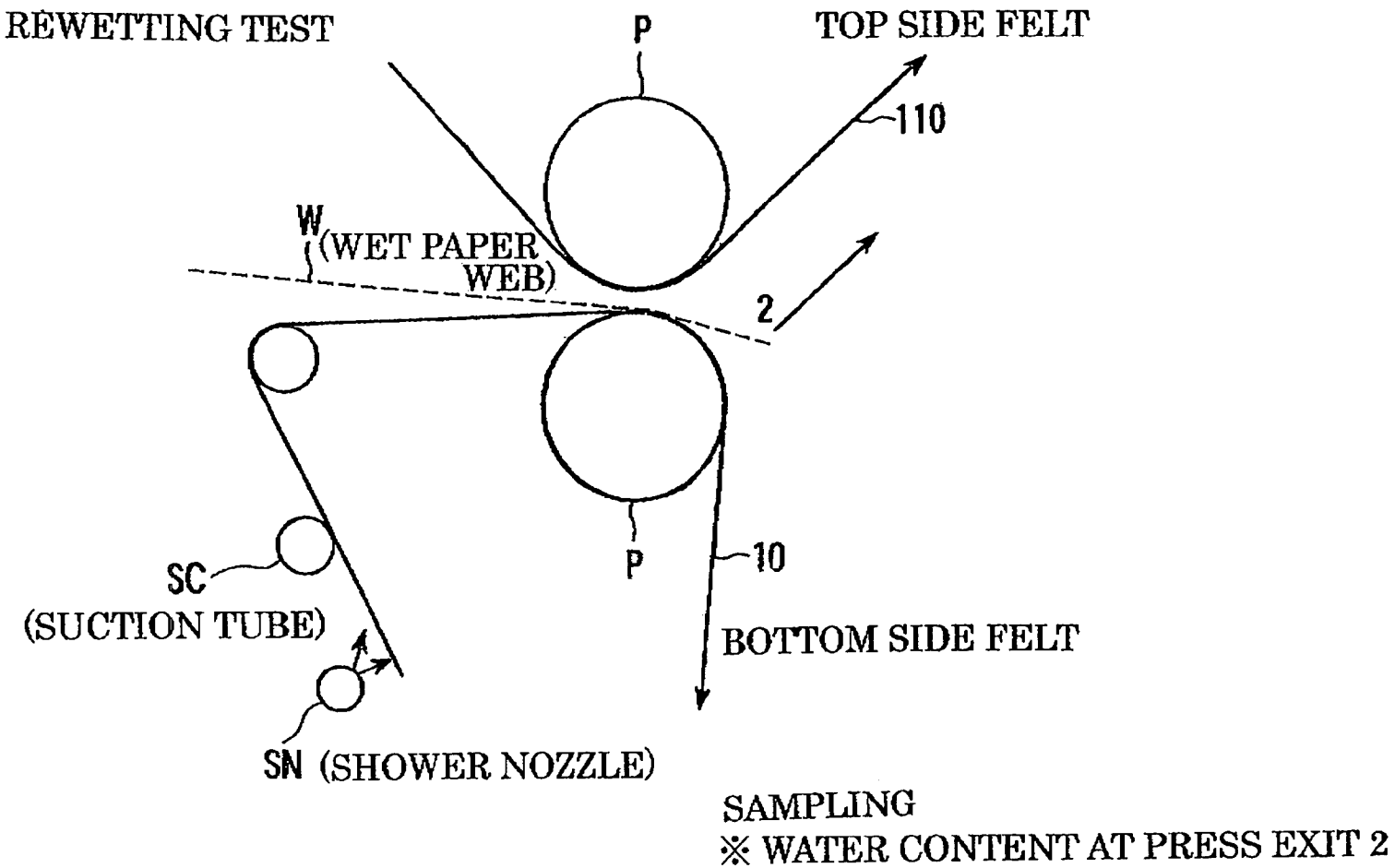
FIG. 10 is a schematic view of another apparatus for determining the effects of a press felt according to the invention.

Tests were conducted by using the papermaking press felts of the above examples, and the comparative examples, and the apparatuses shown in FIGS. 9 and 10.

In the apparatuses shown in FIGS. 9 and 10, P designates a press roll, 110 designates a top side felt, 10 designates a bottom side felt, SC stands for a suction tube, and KN designates a shower nozzle.

The examples in accordance with the invention, and the comparative examples, were used as the bottom side felt 10. The press felt of comparative example 1 was used as the top side felt.

The test apparatuses of FIGS. 9 and 10 both had a felt running speed of 500 m/min, and a press pressure of 100 kg/cm$^2$.

In the apparatus of FIG. 9, a wet paper web released from the nip pressure was placed on a bottom side felt 10 and transferred. Data concerning the water content of the wet paper web, indicating the degree of rewetting, was obtained by measuring the wettability of the wet paper web at the press exit location 1, to which, after release from the nip pressure, the wet paper web was transferred by the bottom side felt.

On the other hand, in the case of the apparatus shown in FIG. 10, the area of a bottom side felt 10 which was in contact with a press roll was comparatively large, and the time during which the wet paper web was in contact with the felts 10 and 110 after release from the nip pressure was very short. Therefore, data concerning the water content of a wet paper web in the case where rewetting does not fully occur may be obtained by measuring the wettability of the wet paper web at the press exit 2 immediately after the wet paper web is released from the nip pressure.

The rewetting phenomenon was evaluated by calculating the difference between the water content obtained by the apparatus of FIG. 9, and the water content obtained by the apparatus shown in FIG. 10. When the difference was below 0.5%, it was judged that rewetting did not occur (evaluation: "○"). On the other hand, when the difference was 0.5% or more and below 1.0%, it was judged that a small amount of rewetting occurred (evaluation: "Δ") and when the difference between them was above 1.0%, it was judged that a rewetting phenomenon occurred (evaluation: "X").

The summary of these results is shown in FIG. 11.

As shown in FIG. 11, it was found out that a papermaking press felt according to the invention was capable of excellent and effective suppression of rewetting.

The effect obtained as a result of the hydrophilic character of the nonwoven fabric was determined by comparing Example 1 with Comparative Example 3.

In addition, it was determined from Examples 1–5 that the basis weight ratio of the outermost portion of the batt layer to the nonwoven fabric layer is preferably in the range from 8:1 to 3:1.

Furthermore, it was determined from Examples 1, 6, and 7 that the fineness of the fibers of the outermost part of the batt layer is preferably 9 dtex or less.

Figure 12:
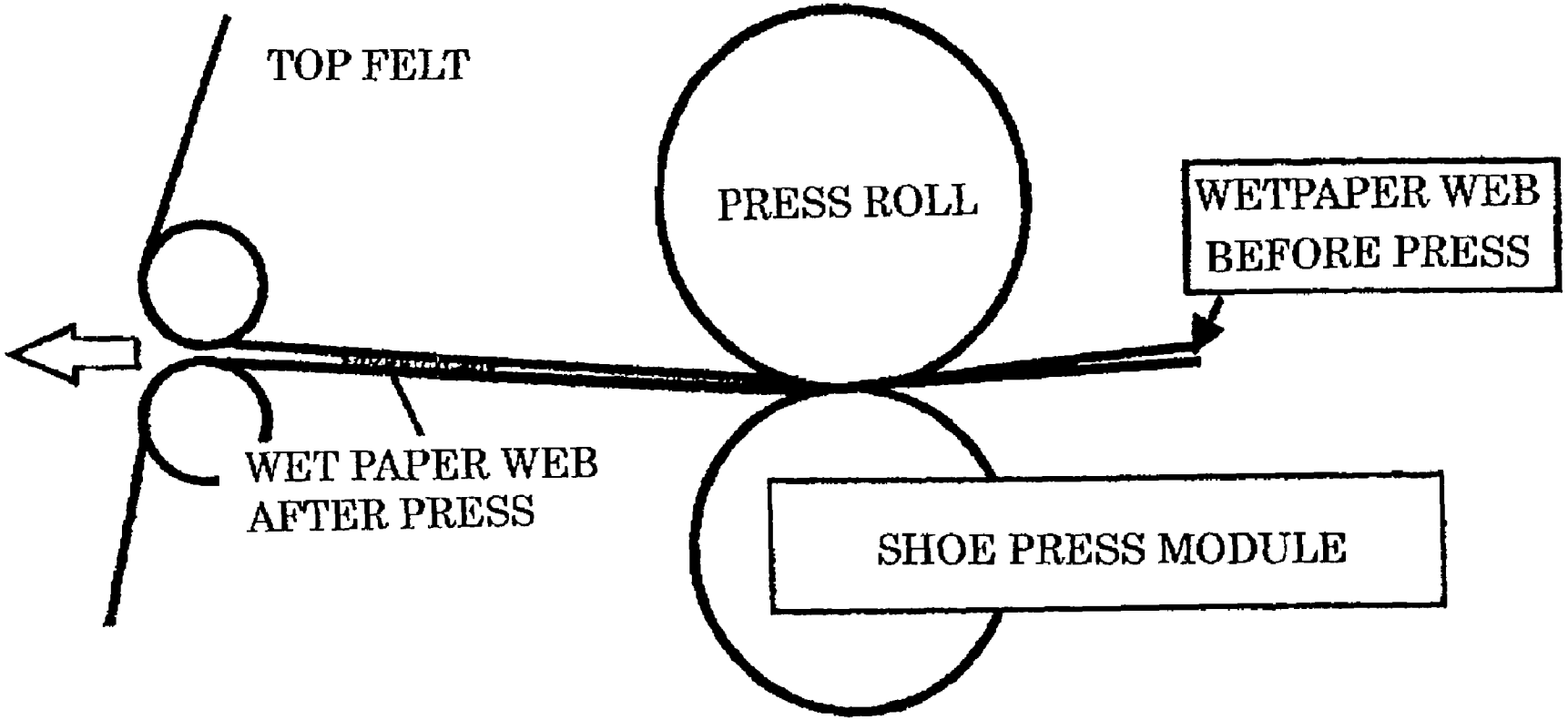
FIG. 12 is a schematic explanatory view of a test apparatus for measuring the amount of rewetting.

Tests were also conducted, using the test apparatus shown in FIG. 12, to determine the effect of changing the period of time during which the felt is in contact with the wet paper web after passing through a press nip. These tests were conducted using two kinds of felts as bottom felts: a conventional felt in accordance with Comparative Example 1, and a felt in accordance with the invention, corresponding to Example 1.

A wet paper web which was not pressed through a press nip. was passed through the test apparatus. The relation between the felt contact time and the observed amount of rewetting was examined by changing the period of time during which a wet paper web was pinched by the top and bottom felts after passing through the press nip. The results are depicted in FIG. 13.

Figure 13:
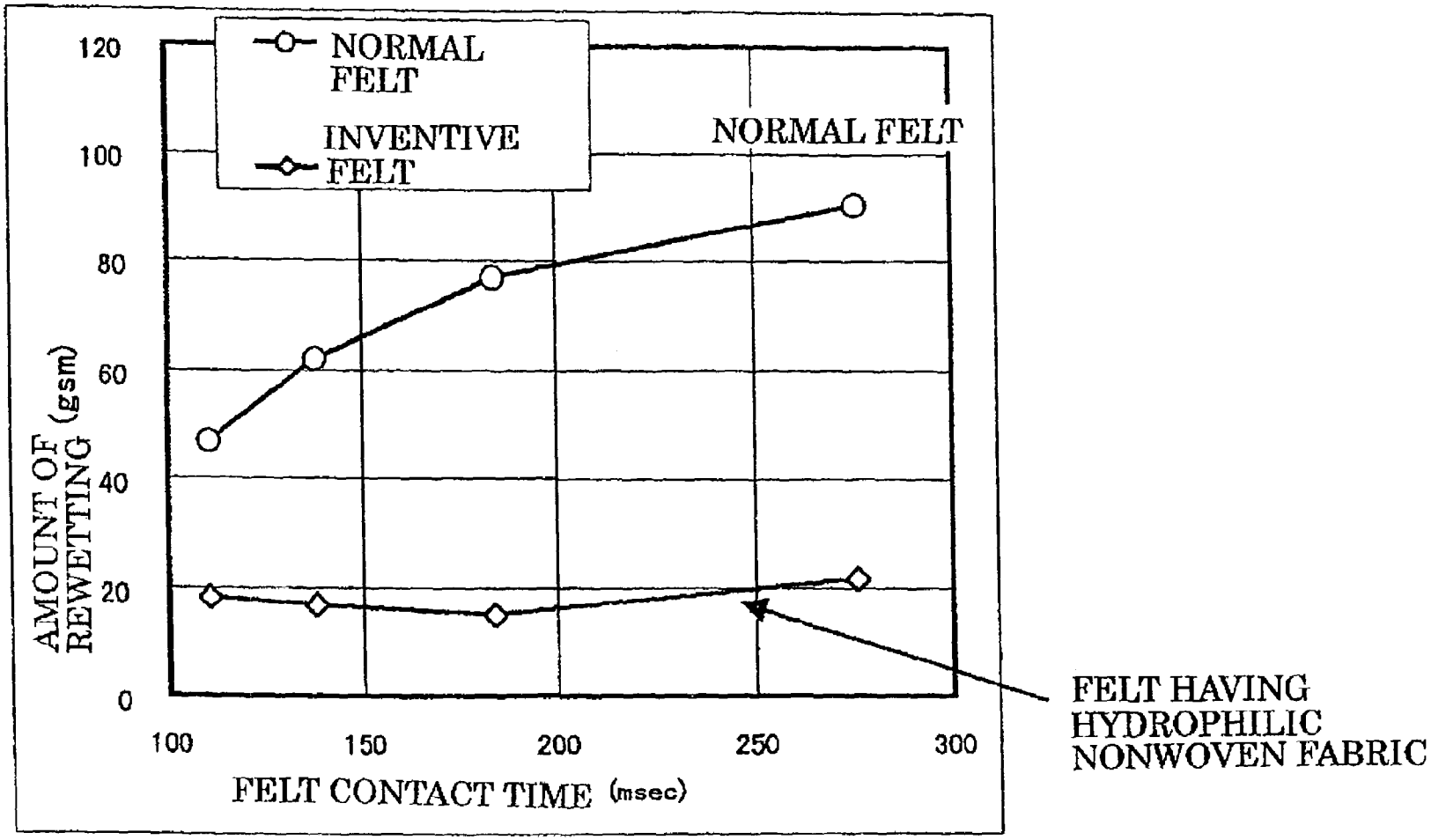
FIG. 13 is chart showing the results of tests conducted using the apparatus of FIG. 12.

As shown in FIG. 13, the felt according to the invention exhibited excellent prevention of rewetting since the amount of rewetting remained substantially constant with increasing felt contact time, whereas, in the case of the conventional felt, the amount of rewetting increased significantly with the increase in felt contact time.

Figure 14:
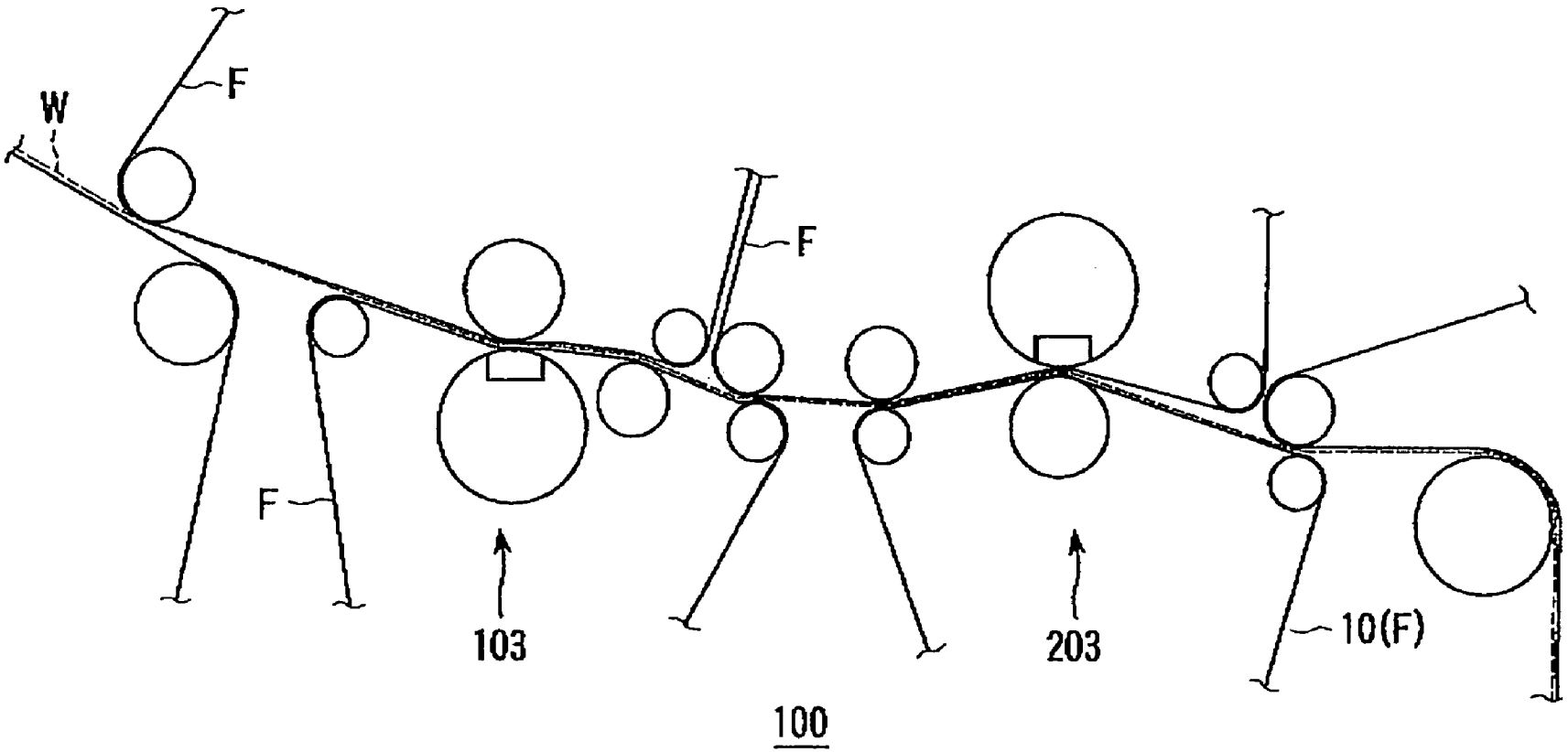
FIG. 14 is a schematic view of a press apparatus of a papermaking machine in which a felt according to the invention is installed.

A papermaking machine 100 on which a felt according to the invention is mounted is shown in FIG. 14. This machine comprises a first press apparatus 103 and a second press apparatus 203 provided in the downstream thereof, both pinching a wet paper web W between two sheets of felt and thereby squeezing water from the wet paper web W. Although FIG. 14 shows the case in which a felt 10 according to the invention is used as a bottom felt in the second press apparatus 203, the invention is not limited to this configuration. The press felt of the invention may be used in the first press apparatus 103, in the second press apparatus 203, or in both the first press apparatus 103 and the second press apparatus 203.

A wet paper web W is pinched between felts, or held on a bottom felt and transferred, so that high-speed transfer of the wet paper web may be obtained. Therefore, a wet paper web may be stably transferred at high speed (without suspension of the paper supply) throughout the whole section as shown in FIG. 14, by holding it between, or on, felts according to the invention.

It is especially desirable to use a felt according to the invention as a bottom felt in the second press apparatus 203, since the final water content of the wet paper web is influenced more by the second press apparatus 203.

In this type of press, where a wet paper web is held between felts or on a felt after passing through a nip, the return of water to the felt as a result of rewetting decreases a water removing capability of the apparatus. However, the water removing capability is greatly improved by replacing a conventional felt with a felt according to the invention.

While FIG. 14 shows a shoe press apparatus in a papermaking machine comprising two shoe presses in series, a felt according to the invention may prevent rewetting effectively even where one of the shoe presses is replaced by a roll press, or when the press part of the machine comprises only one shoe press.

As explained above, according to the invention, a papermaking press felt exhibiting excellent prevention of rewetting may be provided by a relatively simple structure in which a hydrophilic nonwoven fabric is incorporated into the wet paper web side portion of a batt material. When the press felt is used in a press apparatus of a papermaking machine, an excellent water removing capability may be obtained.

What is claimed is:

1. A papermaking press felt comprising a base body and a batt material, said batt material being composed of a wet paper web side layer and a press side layer, and said press felt having a hydrophilic, nonwoven fabric provided in the wet paper web side layer of said batt material, wherein the ratio of the basis weight of the part of the batt material located on the wet paper web side of the hydrophilic nonwoven fabric to the basis weight of the hydrophilic nonwoven fabric is in the range from 8:1 to 3:1.

2. A papermaking press felt as claimed in claim 1, wherein said batt material comprises staple fibers, and wherein the fineness of the staple fibers located on the wet paper web side of said hydrophilic nonwoven fabric is 9 dtex or less.

3. A papermaking press felt as claimed in claim 1, wherein the water contact angle of said hydrophilic nonwoven fabric is 30 degrees or less when the water content of the nonwoven fabric is 30–50%.

4. A papermaking press felt as claimed in claim 2, wherein the water contact angle of said hydrophilic nonwoven fabric is 30 degrees or less when the water content of the nonwoven fabric is 30–50%.

5. A press apparatus for a papermaking machine comprising a first press apparatus and a second press apparatus provided downstream of the first press apparatus in the direction of travel of a wet paper web therethrough, each said press apparatus comprises a felt arranged to remove water from said web, wherein a papermaking press felt as claimed in claim 1 is used as a felt arranged to remove water from said web in at least one of said first and second press apparatuses.

6. A press apparatus for a papermaking machine comprising a first press apparatus and a second press apparatus provided downstream of the first press apparatus in the direction of travel of a wet paper web therethrough, each said press apparatus comprises a felt arranged to remove water from said web, wherein a papermaking press felt as claimed in claim 2 is used as a felt arranged to remove water from said web in at least one of said first and second press apparatuses.

7. A press apparatus for a papermaking machine comprising a first press apparatus and a second press apparatus provided downstream of the first press apparatus in the direction of travel of a wet paper web therethrough, each said press apparatus comprises two sheets of felt arranged to pinch a wet paper web therebetween and thereby remove water from said web, wherein a papermaking press felt as claimed in claim 1 is used as one of said two sheets of felt in at least one of said first and second press apparatuses.

8. A press apparatus for a papermaking machine comprising a first press apparatus and a second press apparatus provided downstream of the first press apparatus in the direction of travel of a wet paper web therethrough, each said press apparatus comprises two sheets of felt arranged to pinch a wet paper web therebetween and thereby remove water from said web, wherein a papermaking press felt as claimed in claim 2 is used as one of said two sheets of felt in at least one of said first and second press apparatuses.

9. A press apparatus for a papermaking machine comprising a press apparatus having two sheets of felt arranged to pinch a wet paper web and thereby remove water from said web, wherein a papermaking press felt as claimed in claim 1 is used as one of said two sheets of felt.

10. A press apparatus for a papermaking machine comprising a press apparatus having two sheets of felt arranged to pinch a wet paper web and thereby remove water from said web, wherein a papermaking press felt as claimed in claim 2 is used as one of said two sheets of felt.

11. A papermaking press felt comprising a base body and a batt material, said batt material being composed of a wet paper web side layer and a press side layer, and said press felt having a hydrophilic, nonwoven fabric provided in the wet paper web side layer of said batt material, wherein the water contact angle of said hydrophilic nonwoven fabric is 30 degrees or less when the water content of the nonwoven fabric is 30–50%.

12. A papermaking press felt as claimed in claim 11, wherein said batt material comprises staple fibers, and wherein the fineness of the staple fibers located on the wet paper web side of said hydrophilic nonwoven fabric is 9 dtex or less.

* * * * *